United States Patent [19]

Broderick et al.

[11] Patent Number: 4,850,946

[45] Date of Patent: Jul. 25, 1989

[54] DRAW TAPE BAG WITH TWO SINGLE WRAP AROUND DRAW TAPES AND METHOD OF MANUFACTURE

[75] Inventors: Kevin Broderick, Victor; Vernon C. Catchman, Palmyra; Fox J. Herrington, Holcomb; Shirley K. Johnston, Sodus Point, all of N.Y.; Robert H. Olson, Beaufort, S.C.; Donald Stell, Palmyra, N.Y.

[73] Assignee: Mobil Oil Corporation, New York, N.Y.

[21] Appl. No.: 216,057

[22] Filed: Jul. 7, 1988

Related U.S. Application Data

[62] Division of Ser. No. 115,308, Nov. 2, 1987, Pat. No. 4,786,189.

[51] Int. Cl.[4] ..... B31B 1/64

[52] U.S. Cl. ..... 493/194; 493/225; 493/928

[58] Field of Search ..... 493/194, 225, 928

[56] References Cited

U.S. PATENT DOCUMENTS

| | | | |
|---|---|---|---|
| 463,597 | 11/1891 | Cussen . | |
| 467,108 | 1/1892 | Cussen . | |
| 835,673 | 11/1906 | Fross . | |
| 1,092,955 | 4/1914 | Sharer . | |
| 3,010,640 | 11/1961 | Kugler . | |
| 3,029,853 | 4/1962 | Piazze . | |
| 3,418,891 | 12/1968 | Rioman | 493/194 |
| 3,506,048 | 4/1970 | Jortikka . | |
| 3,547,341 | 12/1970 | Kirkpatrick . | |
| 3,552,639 | 1/1971 | Meyer . | |
| 3,687,357 | 8/1972 | Hansen | 493/225 |
| 3,738,568 | 6/1973 | Ruda . | |
| 4,260,003 | 4/1981 | Hendrickson . | |
| 4,558,463 | 12/1985 | Boyd . | |
| 4,624,654 | 11/1986 | Boyd et al. . | |
| 4,628,536 | 12/1986 | Herrington . | |

FOREIGN PATENT DOCUMENTS

| | | | |
|---|---|---|---|
| 1183880 | 7/1959 | France . | |
| 1236831 | 6/1960 | France . | |
| 2430895 | 3/1980 | France | 493/928 |
| 1125363 | 8/1968 | United Kingdom . | |

*Primary Examiner*—Frederick R. Schmidt
*Assistant Examiner*—Robert Showalter
*Attorney, Agent, or Firm*—Alexander J. McKillop; Charles J. Speciale

[57] ABSTRACT

A draw type bag with two single draw tapes having a front wall and back wall of flexible sheet material joined to each other along edges of the bag. Tubular channels extend along opposed transverse top edges of the front and back walls. The channels define an open mouth for the bag. Each of the channels has openings at the opposite ends of the top edges of the bag. A pair of draw tapes extends through both of the channels. One end of each of the tapes is attached to opposite side edges of the bag beneath the openings in one of the channels and the other end of each of the tapes extends through the openings at the corresponding ends of the other of the channels so that the tapes cross each other in both channels and wrap around the mouth of the bag whereby when the tapes are pulled the mouth of the bag is drawn tightly together.

1 Claim, 2 Drawing Sheets

DRAW TAPE BAG WITH TWO SINGLE WRAP AROUND DRAW TAPES AND METHOD OF MANUFACTURE

This is a divisional of copending application Ser. No. 115,308, filed on Nov. 2, 1987 now U.S. Pat. No. 4,786,189.

FIELD OF THE INVENTION

The invention relates to the manufacture of flexible bags and particularly to the manufacture of draw tape bags from thermoplastic films having a tight closure.

RELATED APPLICATIONS

The present invention is related to the invention disclosed in our application entitled "DUAL DRAW TAPE BAG AND METHOD OF MANUFACTURE" Ser. No. 100,648, filed Sept. 24, 1987, now U.S. Pat, No. 4,792,241 and our application entitled "DRAW TAPE BAG WITH TWO SINGLE DRAW TAPES AND METHOD OF MANUFACTURE", Ser. No. 100,649, filed Sept. 24, 1987, now U.S. Pat. No. 4,786,191 incorporated herein by reference thereto.

BACKGROUND OF THE INVENTION

Bags made of plastic film such as thin polyethylene film have been used in various sizes. Small bags are used in the packaging of sandwiches and the like; larger bags are used for shopping bags and even larger bags are used for containing trash. The present invention is particularly related to draw band bags having a tight enclosure.

A particularly advantageous closure for such bags includes a draw band or tape constructed from the same polyethylene material. Draw tape bags of this type have been known for several years and have been described in various patents, such as, for example, U.S Pat. No. 3,029,853—Piazze. Bags of this type are formed by two pliable plastic sheets joined to one another on three sides and open at a fourth. A tubular hem is provided at the open end of each sheet and contains a pliable thermoplastic strip. A hole intermediate the ends of each hem exposes the strips in the hems allowing them to be pulled through the openings and used as a handle while simultaneously closing the open mouth of the bag. A similar type bag is disclosed in U.S. Pat. No. 4,624,654—Boyd et al. The draw tapes in the bags disclosed in these patents are at the same level in both hems of the bag. Draw tape bags using two single hems at the same time and different parallel levels in the bags are disclosed in U.S. Pat. No. 3,547,371—Kirkpatrick and U.S. Pat. No. 3,738,568—Ruda. In both of these patents the openings for pulling the draw tapes are at the opposite edges of the bag.

It is an object of the present invention to provide a draw tape bag having two single wrap around draw tapes, each of which is pulled from a different edge of the bag. The tapes are crossed within their respective bag hems so that the mouth of the bag is drawn tightly closed.

SUMMARY OF THE INVENTION

In accordance with the present invention, there is provided a draw tape bag having a front wall and a back wall of flexible sheet material joined to each other along the edges of the bag. Tubular channels extend along opposed transverse top edges of the front wall and back wall, respectively, the channels defining an open mouth for the bag, each of the channels having openings at the opposite ends of the top edges of the bag. A pair of tapes is provided, each of the tapes extending through both of the channels and one end of each of the tape being attached to opposite side edges of the bag beneath the openings in one of the channels and the other end of each of the tapes extending through the opening at the corresponding end of the other of the channels so that the tapes cross each other in both channels and wrap around the mouth of the bag whereby when the tapes are pulled, the top of the bag is drawn tightly together.

Further in accordance with the invention there is provided a method of making a draw tape bag comprising the steps of providing a continuous length of flexible thermoplastic bag material folded once longitudinally having a longitudinal fold edge and two adjoining material layers each with a longitudinal free edge opposite the longitudinal fold edge. The method further includes folding the two longitudinal free edges respectively against the adjoining layers to provide a pair of longitudinal hems of double layer thickness opposite the longitudinal fold edge and providing a hole in each hem at predetermined intervals corresponding to the width of the bags to expose subsequently inserted draw tapes. The method further includes inserting a pair of continuous strip thermoplastic draw tapes in crossed relation into each hem, the tapes being crossed and oscillated up and down for alternate bags so that the end of one tape in the pair of tapes in one hem is below the hole at one side of the bag and in line with the hole at the other side of the bag and the end of the other tape in the pair of tapes in the one hem is in line with the hole at the one side of the bag and below the hole at the opposite side of the bag, and the opposite ends of the pair of tapes in the other hem are in line with the holes at the opposite sides of the bag. The method further includes longitudinally joining together the double layer thickness of each hem to form a channel containing the continuous draw tapes which cross in their respective channels, and transversely sealing and severing the flexible bag material and crossed draw tapes at the predetermined intervals along the length of the flexible bag material to seal the ends of the pair of tapes below the holes in the one hem to the respective sides of the bag and to seal the opposite ends of the pair of tapes in the one hem to corresponding ends of the pairs of tapes in the other hem to form wrap around draw tapes and to separate individual draw tape bags from the continuous length of flexible thermoplastic bag material.

In accordance with another aspect of the invention the flexible sheet material and the tapes comprise thermoplastic film wherein the side edges of the bags and the ends of the draw tapes beneath the openings in the channels are joined together by heat seals.

The foregoing and other objects features and advantages of the invention will be better understood from the following more detailed description and appended claims.

DESCRIPTION OF A PREFERRED EMBODIMENT

The plastic draw tape bags of the present invention may be made from either high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463—Boyd. Apparatus for manufacturing draw tape bags of the present invention is disclosed in U.S. Pat. No. 4,624,654— Boyd et al and the disclosure therein is incorporated therein by reference hereto.

Figure 1:
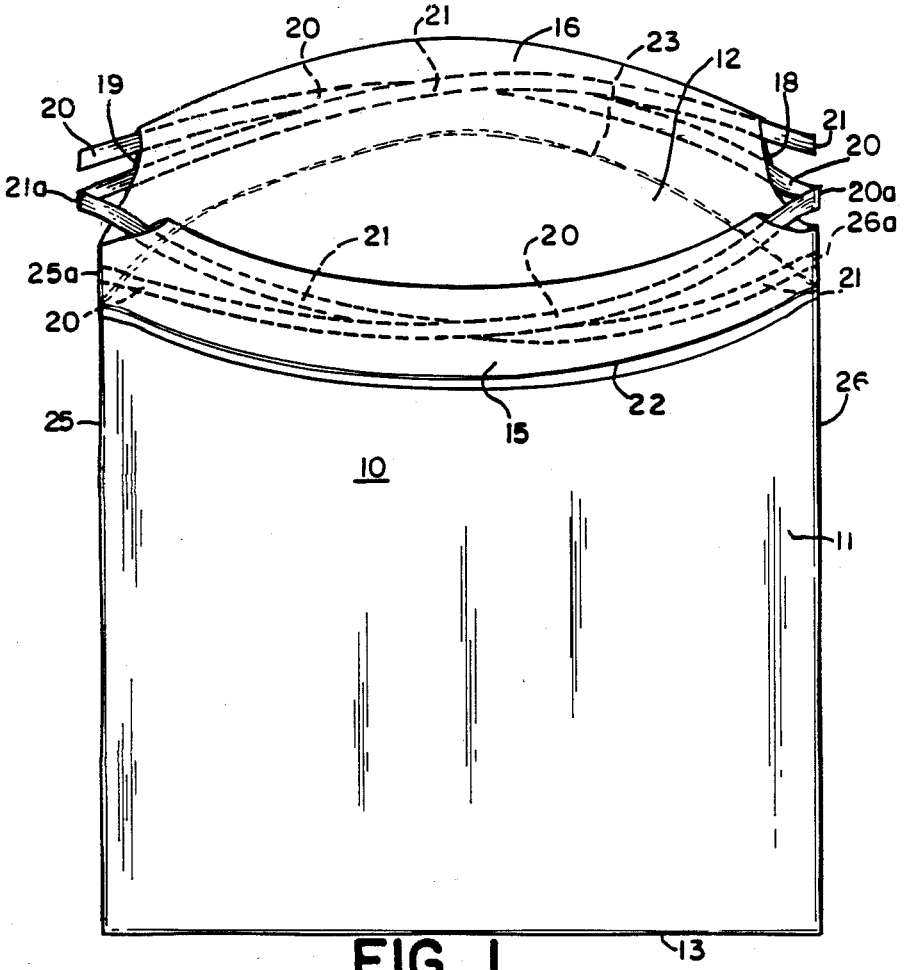
FIG. 1 is a perspective view of a draw tape bag with two single wrap around draw tapes embodying the present invention.

Referring to FIG. 1 it will be seen that a draw tape bag 10 according to the present invention includes a front panel 11 and a rear panel 12. The two panels preferably are formed from a tube of polyethylene which is oriented in the direction of extrusion. The bottom 13 of the bag may be formed by a fold or seal joining the front and back panels 11 and 12. The tube is slit along the top and the two longitudinal free edges are folded over respectively against the adjoining panels 11 and 12 to provide a pair of longitudinal hems 15 and 16 of double layer thickness opposite the longitudinal fold edge of bottom 13. As shown in FIG. 1, the opposite ends of the hems 15 and 16 are provided with openings or holes 18 and 19. Each of the hems 15 and 16 is provided with a tape 20 and 21. It will be noted that the tapes 20 and 21 cross each other in both of the hems 15 and 16. One end of the draw tape 20 and hem 15 is below the hole 19 at one side of the bag 10 where it can be secured to the bag as hereinafter described. The draw tape 20 passes through the hem 15 and back through the other hem 16 so that the other end of the draw tape 20 is in line with the hole 19 in hem 16. One end of the second draw tape 21 in hem 15 is below the hole 18 at one side of the bag 10 so that it can be secured to the side of the bag as hereinafter described. The draw tape 21 then extends through the hem 15 to the opposite side and back through the hem 16 so that the other end of the tape 21 is in line with the hole 18 in hem 16. After the draw tapes 20 and 21 have been inserted in the hems 15 and 16 the double layer thickness of each hem is longitudinally joined to each other along seal lines 22 and 23 to form channels containing the draw tapes 20 and 21.

One end of the draw tape 20 in channel 15 is secured at one side of the bag 10 when the side heat seal 25 is made and one end of the draw tape 21 at the opposite end of the channel 15 is secured to the opposite side of the bag 10 when the side heat seal 26 is made. The opposite or free end of the draw tape 20 extends through the opening 19 at one end of channel 16 and the opposite or free end of the draw tape 21 extends through the opening 18 at the opposite end of the channel 16. Each of the draw tapes 20 and 21 exit from opposite sides of the bag and from the same side of the bag as their sealed end. Since both of the draw tapes 20 and 21 pass through both channels formed by the hems 15 and 16 they wrap around the mouth of the bag.

Figure 2:
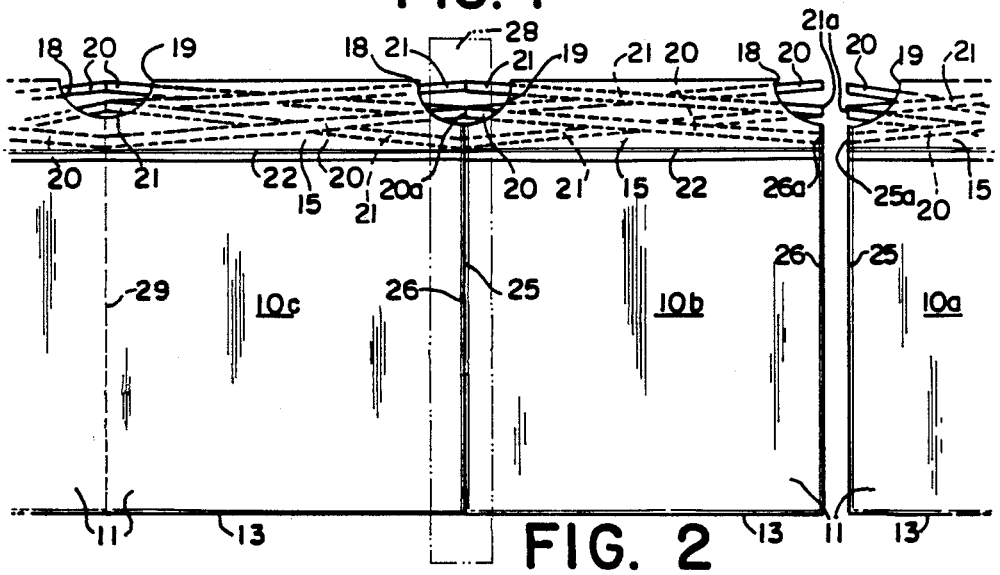
FIG. 2 is a view showing the method of manufacture of the draw tape bag illustrated in FIG. 1.

After the hems have been heat sealed at 22 and 23 the flexible bag material and crossed tapes 20 and 21 are transversely sealed and severed at predetermined intervals, i.e. corresponding to bag width, along the length of the flexible bag material to separate individual draw tape bags from the continuous length of flexible thermoplastic bag material. As shown in FIG. 2 the leading bag **10*a* has been severed from the continuous length of flexible thermoplastic bag material and the next bag 10b in the line is being sealed and concurrently severed as indicated by the sealing/cutter member diagrammatically illustrated at 28. A suitable seal/cutter assembly 28 is well known in the art as disclosed in the aforesaid U.S. Pat. No. 4,624,654. As shown in FIG. 2 the side edges of the next bag 10*c* will be sealed and cut at the dotted line 29** from the continuous length of flexible thermoplastic bag material.

In a preferred method of forming draw tape bags with two single wrap around draw tapes in accordance with the present invention as shown in FIGS. 1 and 2, a continuous length of flexible theromplastic bag material is folded once longitudinally to provide a longitudinal fold edge and two adjoining material layers each with a longitudinal free edge opposite the longitudinal fold edge. The two longitudinal free edges are respectively folded against the adjoining layers to provide a pair of longitudinal hems 15 and 16 of double layer thickness opposite the longitudinal fold edge or bottomm 13. While the free edges have been folded against the outer surface of the panels 11 and 12, FIGS. 1 and 2, it is to be understood that they may be folded against the inner surfaces of these panels. As shown in FIGS. 1 and 2 the openings or holes 18 and 19 at the opposite ends of the hems 15, 16, in the bags 10a-10c are adjacent each other and thus both holes 18 and 19 for adjacent bags may be punched at the same time. The holes are punched at predetermined intervals corresponding to the width of the bags.

After the hems have been formed a pair of continuous strip thermoplastic draw tapes 20 and 21 is inserted in crossed relation in each of the hems 15 and 16. As shown in FIGS. 1 and 2 the tape 20 in the front hem 15 crossed over the tape 21 within that hem while tape 21 in the back hem 16 crosses over the tape 20 within that hem. Also it will be noted that in FIG. 2 the tape 20 in front hem 15 oscillates from right to left in bag **10*b* from a position below the opening 18 to a position in line with the opening 19 at the opposite side of the bag 10b and then back in bag 10*c* from a position in line with opening 18 to a position below the opening 19 of bag 10*c*. The tape 21 within the front hem 15 of bag 10*b* extends from a position in line with the opening 18 to a position below the opening 19 and then from a position below the opening 18 in bag 10c to a position in line with the opening 19 in bag 10*c*. The tapes oscillate uniformly along the bag line for succeeding bags. The two tapes 20 and 21 in the rear hem 16 oscillate to upper and lower positions in line with the openings 18 and 19. The tape 20 is in front of the tape 21 in front hem 15 as they oscillate from bag 10*a* to 10*b* etc. and tape 20 is behind tape 21 in back hem 16. Thus it will be seen in FIG. 2 that with respect to bag 10*b* the tape 21 in the front hem 15 extends from left to right from a position below the opening 19 to a position in line with the opening 18 at the other side of the bag and then it reverses to the left where it extends through the opening 19 in the back hem 16. In the succeeding bag 10c the tape 20 extends from left to right in the front hem 15 from a position below the opening 19 to a position in line with the opening 18 at the opposite side of the bag and the tape 20 then reverses and extends through the back hem 16 and out through opening 19 in the hem 16. Similarly, the other tape 21 extends in the front hem 15 from a position below the opening 18 at the right hand side of the bag 10*c* to a position at the left hand side of the bag in line with the opening 19 and then back through the back hem 16 to a position at the right hand side of the bag extending through the opening 18. Thus it will be seen that the tape 20 in each of the bags is made up from one tape 20 of the pair of tapes in the front hem 15 and one tape 20 of the pair of tapes in the rear hem 16. Similarly, the other draw tape 21 in each of the bags is made up from one tape 21 of the pair of tapes in the front hem 15 and one tape 21 of the pair of tapes in the rear hem 16. These tapes are sealed together at 20***a* and 21*a*, FIGS. 1 and 2, and concurrently severed from the succeeding bag when the side seals 25 and 26 of the bags are made by sealing/cutter assembly 28.

Figure 3:
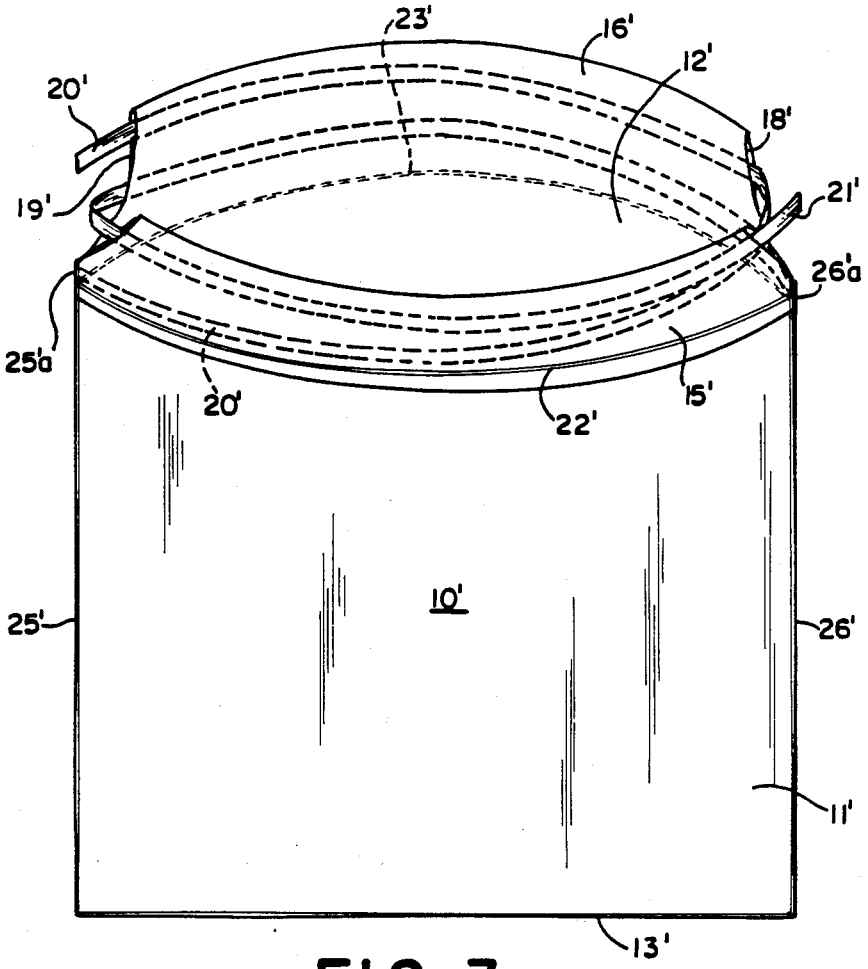
FIG. 3 is a perspective view of a modification of a draw tape bag with two single wrap around draw tapes.

Referring to FIG. 3 there is shown a modification of a draw tape bag with two single draw tapes embodying the present invention. The plastic body of the draw tape bag 10' shown in FIG. 3 is the same as the plastic body of the draw tape bag 10 shown in FIG. 1. The essential difference is in the position of the draw tapes 20' and 21' in the draw tape bag 10' as now to be described. It will be seen in FIG. 3 that the draw tape bag 10' includes a front panel 11' and a rear panel 12' joined at the bottom 13'. The front and back panels 11' and 12' have longitudinal hems 15' and 16' at the mouth of the bag and opposite the bottom 13'. The opposite ends of the hems 15' and 16' are provided with openings or holes 18' and 19'. A pair of tapes 20' and 21' extend through both of the hems 15' and 16' and the hems are sealed at 22' and 23' respectively. As shown in FIG. 3 one end of tape 20' is sealed to the left hand side of the bag 10' in the front hem 15' at 25'a when said seal 25' is made. Tape 20 extends through hem 15' to the right hand side of the bag and back through the rear hem 16' and out through the opening 19' in the rear hem 16'. The draw tape 21' is secured to the right hand side of the bag in the rear hem 16' at 26'a when side seal 26' is made. Tape 21' extends through the rear hem 16' and back through the front hem 15' and out through the opening 18' in the front hem 15' at the right hand end of the bag 10'. Thus it will be seen that each of the draw tapes 20' and 21' exit from opposite sides of the bag 10' and from the same side of the bag 10' as their sealed ends. However, in the modification shown in FIG. 3 the tapes 20' and 21' exit from the opposite ends of different hems in the bag rather than from the same hem as in the embodiment illustrated in FIG. 1. Since both of the draw tapes 20' and 21' pass through both channels formed by the hems 15' and 16' they wrap around the mouth of the bag 10'.

Draw tape bags produced according to the present invention have numerous advantages. For example in same applications, such as food storage bags, it is necessary to have a tight closure. It is not possible to provide a tight closure in prior art bags where the hole for the draw tapes is at the center of the bag rather than at the ends. By utilizing two single crossed draw tapes where the ends are pulled from the opposite sides of the bag it is possible to squeeze the film tightly and make a tight closure for the bag. By crossing the tapes, the tapes will squeeze the film directly and by extending the tapes through both of the hems the tapes wrap around the mouth of the bag and close the bag more tightly.

What is claimed is:

1. A method of forming a draw tape bag comprising the steps of:

providing a continuous length of flexible thermoplastic bag material folded once longitudinally having a longitudinal fold edge and two adjoining material layers each with a longitudinal free edge opposite the longitudinal fold edge;

folding the two longitudinal free edges respectively against the adjoining layers to provide a pair of longitudinal hems of double layer thickness opposite the longitudinal fold edge;

providing a hole in each hem at predetermined intervals corresponding to the width of the bags to expose subsequently inserted draw tapes;

inserting a pair of continuous strip thermoplastic draw tapes in crossed relation into each hem, the tapes being crossed and oscillated up and down for succeeding bags so that the end of one tape in the pair of tapes in one hem is below the hole at one side of the bag and in line with the hole at the other side of the bag and the end of the other tape in the pair of tapes in the one hem is in line with the hole at one side of the bag and below the hole at the opposite side of the bag, and the opposite ends of the pair of tapes in the other hem are in line with the holes at the opposite sides of the bag;

longitudinally joining together the double layer thicknesses of each hem to form a channel containing the continuous draw tapes which cross in their respective channels; and transversely sealing and severing the flexible bag material and crossed draw tapes at the predetermined intervals along the length of the flexible bag material to seal the ends of the pair of tapes below the holes in the one hem to the respective sides of the bag and to seal the opposite ends of the pair of tapes in the one hem to the corresponding ends of the pairs of tapes in the other hem to form wrap around draw tapes and to separate individual draw tape bags from the continuous length of flexible thermoplastic bag material.

* * * * *